US005803177A

United States Patent [19]

Hriscu et al.

[11] Patent Number: 5,803,177

[45] Date of Patent: Sep. 8, 1998

[54] WELL TREATMENT FLUID PLACEMENT TOOL AND METHODS

[75] Inventors: Iosif J. Hriscu; Donald W. Winslow, both of Duncan, Okla.

[73] Assignee: Halliburton Energy Services, Duncan, Okla.

[21] Appl. No.: 760,095

[22] Filed: Dec. 11, 1996

[51] Int. Cl.[6] ..... E21B 23/06; E21B 34/08; E21B 43/12

[52] U.S. Cl. ..... 166/305.1; 166/142; 166/185; 166/202; 166/222; 166/386

[58] Field of Search ..... 166/142, 185, 166/188, 202, 222, 305.1, 317, 319, 321, 383, 386

[56] References Cited

U.S. PATENT DOCUMENTS

| | | | |
|---|---|---|---|
| 2,897,897 | 8/1959 | Breukelman | 166/202 X |
| 3,153,451 | 10/1964 | Chancellor et al. | 166/202 X |
| 3,186,483 | 6/1965 | Schwab | 166/305.1 |
| 3,648,777 | 3/1972 | Arterbury et al. | 166/202 X |
| 4,270,608 | 6/1981 | Hendrickson et al. | 166/278 |
| 4,273,190 | 6/1981 | Baker et al. | 166/278 |
| 4,552,215 | 11/1985 | Almond et al. | 166/278 |
| 4,569,396 | 2/1986 | Brisco | 166/185 X |
| 4,726,419 | 2/1988 | Zunkel | 166/51 |
| 4,834,176 | 5/1989 | Renfroe, Jr. | 166/142 |
| 5,117,910 | 6/1992 | Brandell et al. | 166/185 X |
| 5,295,542 | 3/1994 | Cole et al. | 166/278 |
| 5,343,949 | 9/1994 | Ross et al. | 166/278 |
| 5,363,916 | 11/1994 | Himes et al. | 166/276 |
| 5,390,737 | 2/1995 | Jacobi et al. | 166/142 X |

*Primary Examiner*—George A. Suchfield
*Attorney, Agent, or Firm*—Stephen R. Christian; C. Clark Dougherty, Jr.

[57] ABSTRACT

The present invention provides a tool and methods of placing a treatment fluid in a subterranean formation penetrated by a well bore by way of selected perforations extending from casing cemented in the well bore into the formation. The fluid placement tool includes a fluid flow passageway extending therethrough, at least one resilient self expandable cup type packer attached thereto and a valve disposed in the fluid flow passageway which closes the passageway when a closing plug is dropped into the tool. The placement tool is capable of releasing the cup type packer whereby it provides a seal between the tool and the casing when a first predetermined fluid pressure is applied to the tool after a closing plug is dropped therein and opening the fluid flow passageway whereby the treatment fluid is discharged from the tool below the packer when the fluid pressure is increased to a second predetermined fluid pressure. Methods of using the tool are also provided.

20 Claims, 4 Drawing Sheets

WELL TREATMENT FLUID PLACEMENT TOOL AND METHODS

BACKGROUND OF THE INVENTION

1. Field of the Invention

The present invention relates to a well treatment fluid placement tool and methods of using the tool in performing remedial procedures.

2. Description of the Prior Art

The gravel packing of well bores and the perforations extending therefrom into producing intervals in subterranean formations has been practiced for many years. Such gravel packing involves the placement of a tightly packed mass of particulate solid material, e.g., sand, in the well bore and perforations so that loose and incompetent subterranean formation materials produced with hydrocarbons are screened out by the gravel pack and are prevented from entering the well bore.

A gravel pack is typically formed in a well bore by injecting a carrier liquid having a particulate solid pack material suspended therein into the perforations whereby the perforations are packed with the particulate material. A tubular gravel pack screen is then placed in the well bore adjacent the packed perforations and the carrier liquid particulate solid material suspension is injected into the annulus between the screen and the well bore whereby the particulate material is screened out of the carrier liquid and a pack of the material is formed in the annulus.

A continuing problem which has been associated with gravel packing procedures has occurred in wells where the producing interval is of increasing permeability from the bottom up. When a carrier liquid-particulate solid material suspension is injected into all or a major portion of the perforations penetrating the producing interval, which has been the usual practice, most of the particulate solid material enters the top perforations with little of the material entering the bottom perforations. That is, the usual practice involves the steps of lowering an injection tool having a packer associated therewith to a position above the producing interval, setting the packer and then introducing the carrier fluid-solid particulate material suspension into the entire producing interval by way of all of the perforations penetrating it. Since most of the carrier liquid suspension enters the upper most permeable portion of the producing interval, most of the particulate material is deposited therein leaving the lower perforations devoid of particulate material and open to the production of formation solids.

Thus, there is a need for an improved carrier liquid-particulate material suspension injection tool which can be utilized for injecting the suspension into selected perforations, e.g., the lowest set of perforations penetrating the least permeable portion of the producing interval followed by successively injecting the suspension through each set of perforations above the lowest set whereby all of the perforations penetrating the producing interval are adequately packed.

Such an improved tool can also be used for injecting other treatment fluids into selected perforations in subterranean formations, e.g., cement slurries, gelled and/or crosslinked polymer fluids and the like to terminate undesirable water production or other similar purpose.

SUMMARY OF THE INVENTION

The present invention provides an improved well treatment fluid placement tool and methods of using the tool for performing gravel packing and other remedial procedures which meet the needs described above and overcome the deficiencies of the prior art. The improved well treatment fluid placement tool of this invention is basically comprised of an elongated inner mandrel having a fluid flow passageway therethrough, having at least one lateral fluid flow port therein, having an outer shoulder formed thereon and having a lateral fluid passage extending from the axial fluid flow passageway to the exterior of the inner mandrel near the outer shoulder.

At least one resilient self expandable cup type packer for providing a seal between the inner mandrel and the casing in the well bore is attached to the inner mandrel, and a tubular piston member is slidably disposed over the inner mandrel and over the cup type packer attached thereto. The tubular piston member includes an inner shoulder formed therein which is complimentary to the outer shoulder on the inner mandrel whereby fluid pressure exerted between the shoulders by way of the lateral passage and the axial fluid flow passageway of the inner mandrel moves the piston member from a first position whereby the cup type packer is covered and compressed inwardly to a second position whereby the cup type packer is uncovered. Shearable means such as one or more shear pins maintain the tubular piston member in the first position until a predetermined fluid pressure is exerted between the shoulders of the inner mandrel and the piston member.

A sleeve valve for receiving a closing plug, such as a ball, is slidably disposed within the axial fluid flow passageway of the inner mandrel whereby when fluid pressure is exerted on the sleeve valve with the closing plug seated thereon, the sleeve valve moves from a first position whereby the lateral fluid flow port in the inner mandrel is closed to a second position whereby the lateral fluid flow port is opened. The sleeve valve is maintained in its first position by shearable means such as one or more shear pins until a predetermined fluid pressure is exerted on the sleeve valve.

The methods of using the treatment fluid placement tool of this invention basically comprise the steps of connecting the tool to tubing or a pipe string and lowering the tool and the tubing or pipe string in the well bore to the formation. A closing plug is then dropped into the tool whereby the sleeve valve and the axial fluid flow passageway of the tool are closed. The fluid pressure exerted on the tool is then increased to the first predetermined fluid pressure so that the piston member thereof is moved from its first position to its second position whereby the cup type packer is uncovered and released. The tool is next positioned whereby the packer is above a selected set or group of perforations, and the fluid pressure exerted on the tool is increased to the second predetermined fluid pressure. As a result, the sleeve valve is moved from its first position to its second position thereby opening the axial fluid flow passageway and the lateral fluid flow port of the tool and the treatment fluid is placed in the portion of the producing interval penetrated by the selected perforations.

It is, therefore, a general object of the present invention to provide an improved well treatment fluid placement tool and methods of using the tool.

Other and further objects, features and advantages of the present invention will be readily apparent to those skilled in the art upon a reading of the description of preferred embodiments which follows when taken in conjunction with the accompanying drawings.

BRIEF DESCRIPTION OF THE DRAWINGS

FIG. 6 is a side elevational view, partially in cross-section, similar to FIG. 2 but showing the upper intermediate portion of the tool after the tubular piston member has moved upwardly.

DESCRIPTION OF PREFERRED EMBODIMENTS

Figure 2:
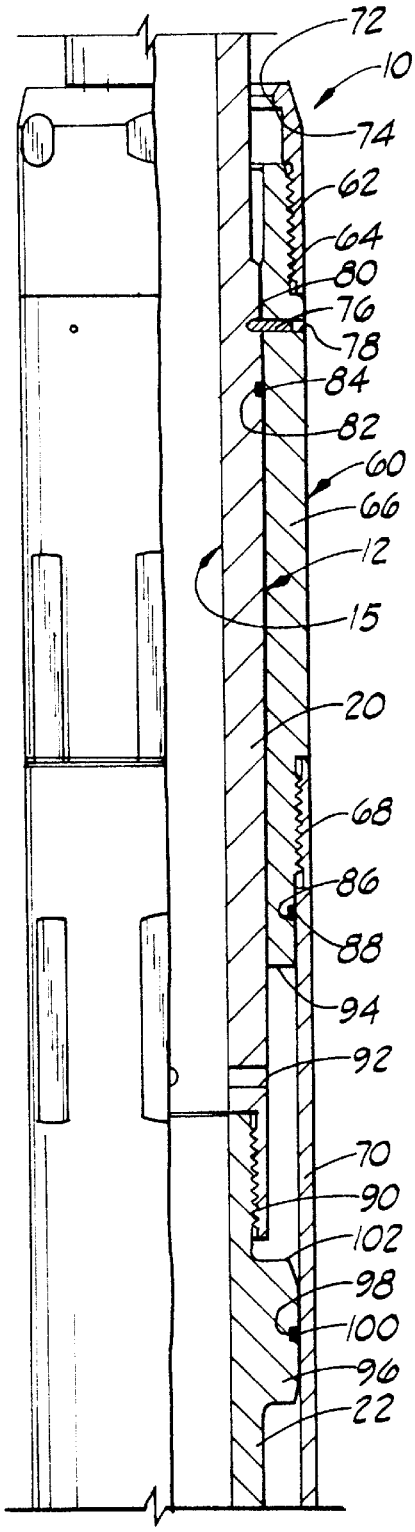
FIG. 2 is a side elevational view, partially in cross-section, of an upper intermediate portion of the tool of this invention adjacent to and below the portion depicted in FIG. 1.
Figure 3:
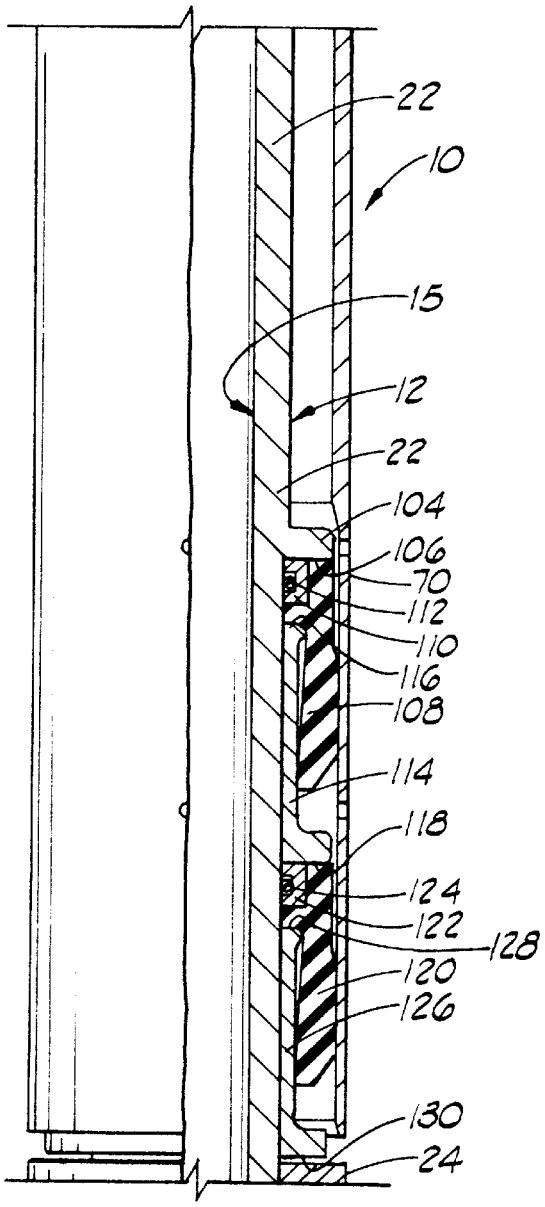
FIG. 3 is a side elevational view, partially in cross-section, of a lower intermediate portion of the tool of this invention adjacent to and below the portion depicted in FIG. 2.
Figure 4:
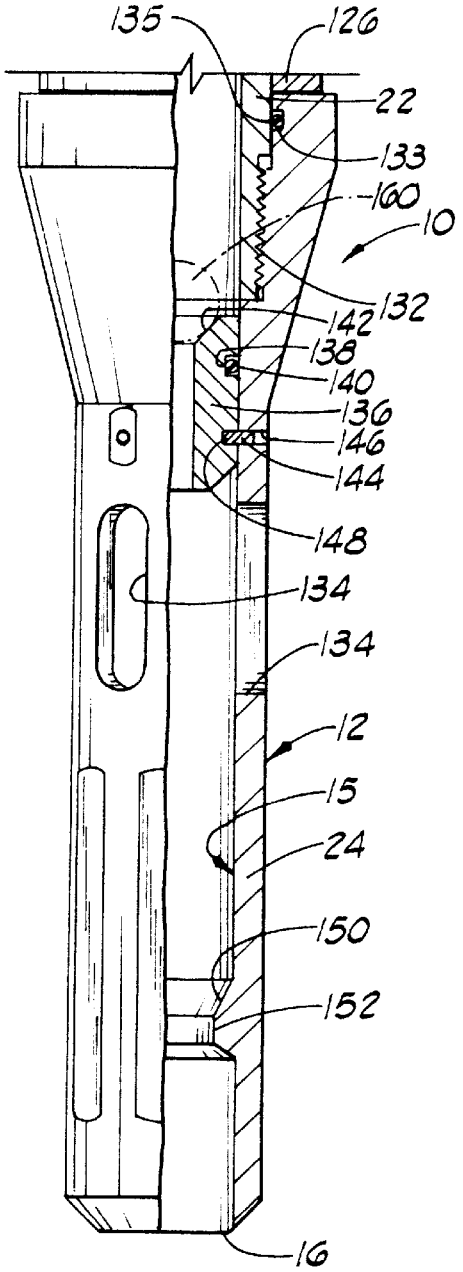
FIG. 4 is a side elevational view, partially in cross-section, of a lower portion of the tool of this invention adjacent to and below the portion depicted in FIG. 3.

Referring now to the drawings and particularly to FIGS. 1–4, the treatment fluid placement tool of the present invention is illustrated and generally designated by the numeral 10. The tool 10 is comprised of an inner mandrel 12 having a top end 14 (FIG. 1) and a bottom end 16 (FIG. 4). The inner mandrel includes an axial fluid flow passageway 15 extending from the top end 14 to the bottom end 16. For ease of construction and assembly, the inner mandrel 12 is made up of four parts which are threadedly connected together, namely, a top connector 18 (FIG. 1) adapted to be connected to a length of coiled tubing or a pipe string such as a tubing string or drill pipe string, an upper mandrel 20 (FIGS. 1 and 2), a packer mandrel 22 (FIGS. 2, 3 and 4) and a ported bottom member 24 (FIG. 4).

Figure 1:
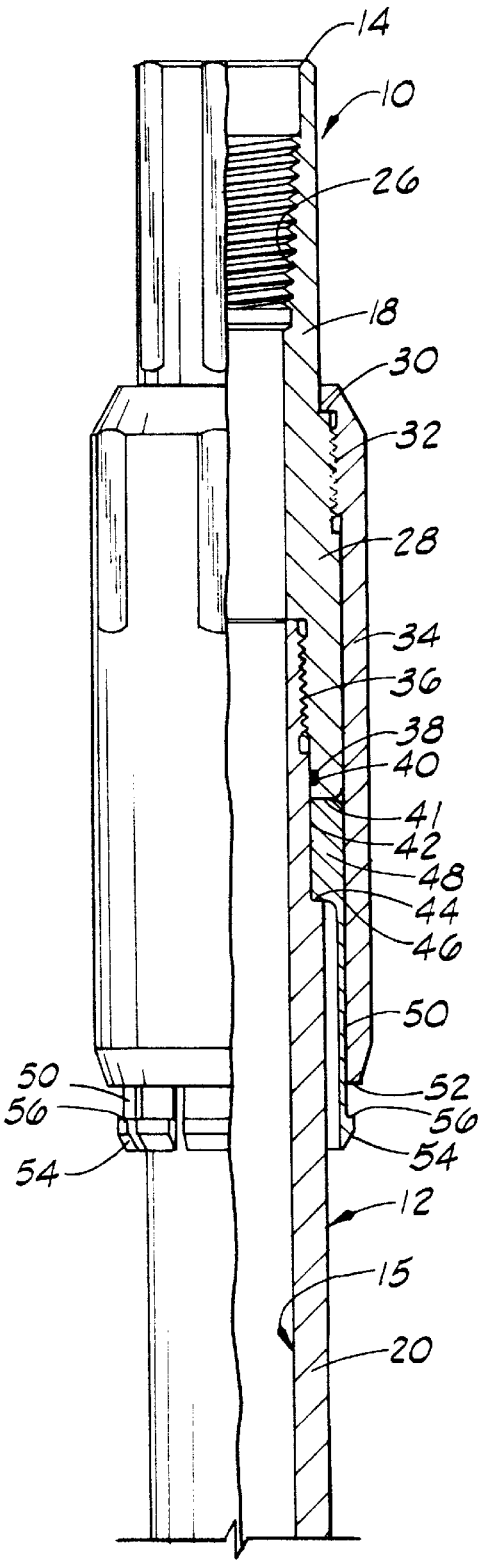
FIG. 1 is a side elevational view, partially in cross-section, of an upper portion of the well treatment fluid placement tool of this invention.

The upper connector 18 includes internal threads 26 for threaded connection to complimentary threads on a coiled tubing connector, a tubing string or a drill string (not shown). A lower portion 28 of the connector 18 is enlarged thereby forming an upwardly facing outer annular shoulder 30 on the upper connector 18. External threads 32 are provided on the enlarged portion 28 and a tubular collet case 34 is threadedly connected to and extends over the enlarged portion 28 of the upper connector 18 as illustrated in FIG. 1. The upper mandrel 20 is threadedly connected to the upper connector 18 at a threaded joint 36. An internal annular groove 38 is provided in the upper connector 18 near the lower end 41 thereof and an O-ring 40 is disposed in the groove 38 for providing a seal between the upper connector 18 and the upper mandrel 20. An upper end portion 42 of the upper mandrel 20 just below the threaded joint 36 is of a reduced diameter whereby an external upwardly facing annular shoulder 44 is formed on the upper mandrel 20.

The lower portion of the collet case 34 extends over the reduced diameter portion 42 and a part of the portion below the shoulder 44 of the upper mandrel 20. Disposed between the upper mandrel 20 and the collet case 34 is an annular collet 46. The collet 46 includes an enlarged upper end portion 48 which is held between the annular bottom end 41 of the upper connector 18 and the annular upwardly facing shoulder 44 on the upper mandrel 20. The collet 46 also includes a plurality of flexible collet fingers 50 which extend below the bottom end 52 of the collet case 34. Each of the collet fingers 50 include an enlarged head portion 54 which provide upwardly facing shoulders 56 for latching to a collet retainer to be described hereinbelow.

A tubular piston member 60 is slidably disposed over the inner mandrel 12 a distance below the collet case 34. The tubular piston member 60 is made up of three threadedly connected parts, namely, a collet retainer 62, a piston 66 and a sliding packer retaining sleeve 70.

The collet retainer 62 is threadedly connected to the piston 66 at a threaded joint 64 and includes a reduced internal diameter upper end portion 72 which forms an internal downwardly facing annular shoulder 74. As will be described further, the interior downwardly facing annular shoulder 74 is complimentary to and latches on the upwardly facing annular shoulders 56 of the collet fingers 50.

The piston 66 of the tubular piston member 60 is connected to the sliding packer retaining sleeve 70 at a threaded joint 68. The piston 66 is also connected to the inner mandrel 20 by at least one shear pin 76 which is engaged in a bore 78 in the piston 66 and extends into a recess 80 in the inner mandrel 20. An annular external groove 82 is provided in the inner mandrel 20 and an O-ring 84 is disposed within the groove 82 for providing a seal between the piston 66 and the inner mandrel 20. An external annular groove 86 is provided in the lower end portion of the piston 66 and an O-ring 88 is disposed in the groove 86 for providing a seal between the piston 66 and the sliding packer retaining sleeve 70.

As shown in FIG. 2, the packer mandrel 22 is threadedly connected to the bottom end of the inner mandrel 20 at a threaded joint 90. The inner mandrel 20 includes a lateral fluid passage 92 which extends from the axial fluid flow passageway 15 of the upper mandrel 20 and the inner mandrel 12 to the exterior thereof. The lateral fluid passage 92 is positioned between the bottom end 94 of the piston 66 (which forms a downwardly facing shoulder 94 in the tubular piston member 60) and the threaded joint 90. The packer mandrel 22 includes an enlarged outwardly extending portion 96 on which the inner surfaces of the sliding packer retaining sleeve 70 slide. An annular groove 98 is disposed in the outer surface of the enlarged portion 96 and an O-ring 100 is disposed in the groove 98 for providing a seal between the packer mandrel 22 and the sliding sleeve 70. The enlarged portion 96 of the packer mandrel 22 forms an upwardly facing outer shoulder 102 on the packer mandrel 22 and the inner mandrel 12 and, as mentioned above, the end of the piston 66 forms a downwardly facing inner shoulder 94 in the tubular piston member 60. As will be described further hereinbelow, when fluid pressure is exerted between the outer shoulder 102 of the inner mandrel 12 and the inner shoulder 94 of the tubular piston member 60 by way of the lateral passage 92 and the axial fluid flow passageway 15 of the inner mandrel 12, the tubular piston member 60 is moved upwardly from its first position shown in FIGS. 2 and 3 to a second position shown in FIGS. 5, 6 and 7.

Referring now to FIG. 3, the packer mandrel 22 includes a second enlarged diameter portion 104 which forms a downwardly facing exterior annular shoulder 106 thereon. Positioned adjacent to the downwardly facing annular shoulder 106 is a first resilient self expandable cup type packer 108. The packer 108 has an interior annular metallic channel member 110 bonded thereto having an O-ring 112 disposed therein for providing a seal between the packer 108 and the packer mandrel 22. An annular metallic spacer 114 having an L-shaped cross-section clamps the cup type packer 108 between its upper end 116 and the downwardly facing shoulder 106 of the packer mandrel 22. A second resilient self expandable cup type packer 120 is disposed on the packer mandrel 22 below the spacing member 114. The packer 120 also includes a metallic annular channel member 122 bonded thereto having an O-ring 124 disposed therein for providing a seal between it and the packer mandrel 22. A second annular spacer 126 of L-shaped cross-section clamps the packer 120 between its top end 128 and the downwardly facing bottom end 118 of the spacer 114. The cup type packers 108 and 120, as well as the annular spacers 114 and 126 are held in place by the ported member 24. As shown in FIG. 3, the sliding packer retaining sleeve 70 covers and compresses the cup type packers 108 and 120 when the tubular piston member 60 is in its first position.

Referring now to FIG. 4, the ported member 24 which is the lowest part of the inner mandrel 12 is threadedly connected to the packer mandrel 22 at a threaded joint 132. An annular groove 133 is disposed in the ported member 24 and an O-ring 135 is disposed in the groove 133 for providing a seal between the ported member 24 and the packer mandrel 22. The ported member 24 includes at least one lateral port 134 (two are shown). In addition, a sleeve valve 136 is slidably disposed within the axial fluid flow passageway 15 of the ported member 24 and inner mandrel 12. The sleeve valve 136 includes an exterior annular groove 138 having an O-ring 140 disposed therein for providing a seal between it and the ported member 24. In addition, the sleeve valve 136 includes an annular tapered seat 142 formed thereon for receiving a closing plug such as a ball 160 shown by a dashed line on FIG. 4. At least one shear pin 144 is engaged within a lateral bore 146 in the ported member 24 and extends into a recess 148 in the sleeve valve 136. The shear pin 144 maintains the sleeve valve 136 in the position illustrated in FIG. 4 until a predetermined fluid pressure is exerted on the sleeve valve 136 with a closing plug seated thereon which shears the shear pin 144. As will be understood, when fluid pressure is exerted on the sleeve valve 136 with a closing plug seated thereon after the shear pin 144 has sheared, the sleeve valve is moved from its first position as shown in FIG. 4 whereby the lateral ports 134 of the ported member 24 are closed to a second position below the lateral ports 134 (see FIG. 8) whereby the lateral ports 134 are open and the sleeve valve 136 is seated on an internal annular surface 150 formed within the ported member 24 by a reduced diameter portion 152 thereof.

Operation and Methods of Using the Tool 10

After a well bore has been drilled into a subterranean producing formation and casing or a liner has been cemented in the well bore, a plurality of perforations are formed through the casing and into the subterranean formation over a producing interval. When the producing interval is formed in a formation containing loose or incompetent particulate material, e.g., sand, a commonly used technique used to prevent the production of the formation sand with hydrocarbons is to form a gravel pack in the perforations and well bore. That is, the perforations are packed with particulate material of a size which screens out the loose or incompetent formation sand. As described above, additional particulate material is packed in the well bore around a screen whereby any formation sand which does pass through the perforations is screened out of the hydrocarbons produced into the well bore. As also mentioned above, in wells where the permeability of the formation changes over the height of the producing interval containing the perforations, the heretofore utilized particulate material packing techniques have often resulted in a major portion of the particulate pack material entering the highly permeable portions of the interval with little or no pack material entering the less permeable portions thereby producing a defective gravel pack which does not stop the production of formation sand with produced hydrocarbons.

In other well remedial procedures such as minimizing the production of formation water, treating fluids such as cement or other hardenable material slurries, hydrated/crosslinked polymer solutions and the like are selectively introduced into certain portions of a producing interval in a subterranean formation. These and other operations where treatment fluids are placed into a formation by way of selected perforations are accomplished in accordance with the present invention as follows.

A fluid placement tool 10 of this invention is connected to coiled tubing, a tubing string, a drill string or other pipe string, and the tool and tubing or pipe string are lowered in the well bore to the subterranean formation containing a producing interval to be treated. When the tool is positioned adjacent the producing interval, it is as shown in FIGS. 1–4. That is, the tubular piston member 60 is maintained in its first position on the tool 10 by the shear pin 76 as shown in FIG. 2, and it covers and compresses the cup type packers 108 and 120 inwardly as shown in FIG. 3. In addition, the sleeve valve 136 is maintained in its first position by the shear pin 144 as shown in FIG. 4 whereby when a closing plug is seated on the sleeve valve 136, the sleeve valve 136 and the axial flow passageway 15 of the tool 10 are closed. The lowering of the tool 10 in the well bore to the producing interval to be treated is facilitated by the cup type packers 108 and 120 being compressed inwardly and covered. That is, the overall streamlined shape of the tool 10 allows it to readily pass through restrictions in the well bore before the packers are displaced.

Figure 5:
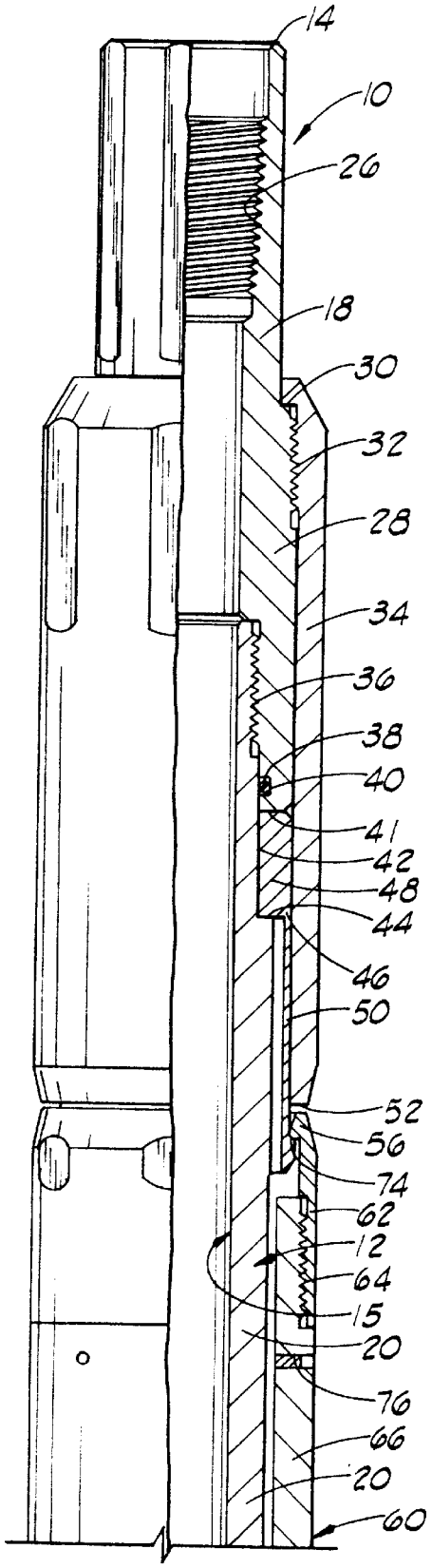
FIG. 5 is a side elevational view, partially in cross-section, similar to FIG. 1 but showing the upper portion of the tool after the tubular piston member thereof has been moved upwardly and latched in place.
Figure 5:
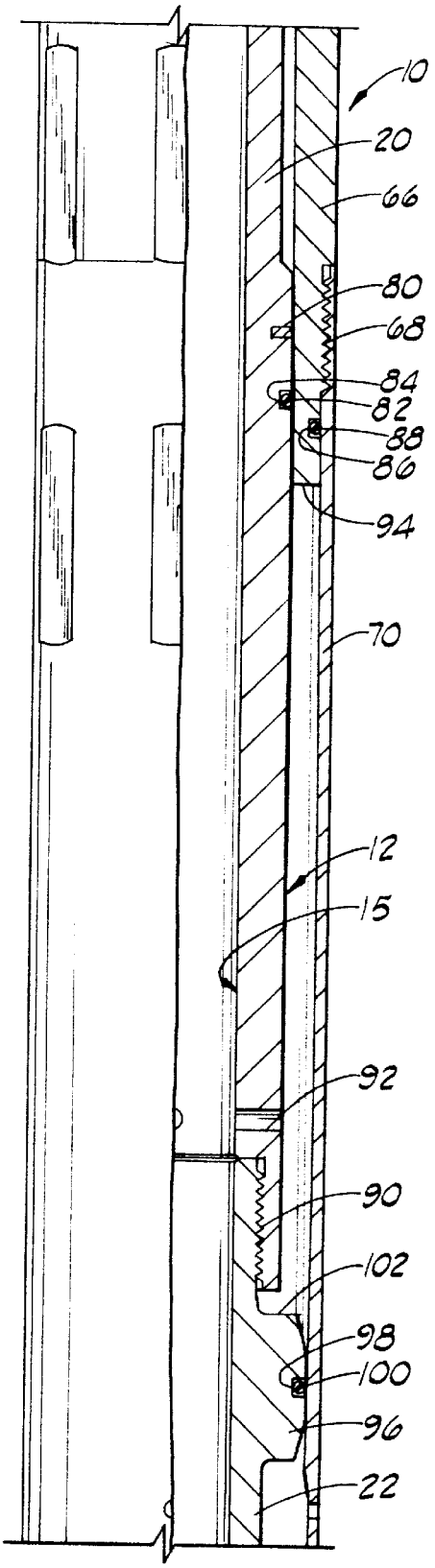
Figure 7:
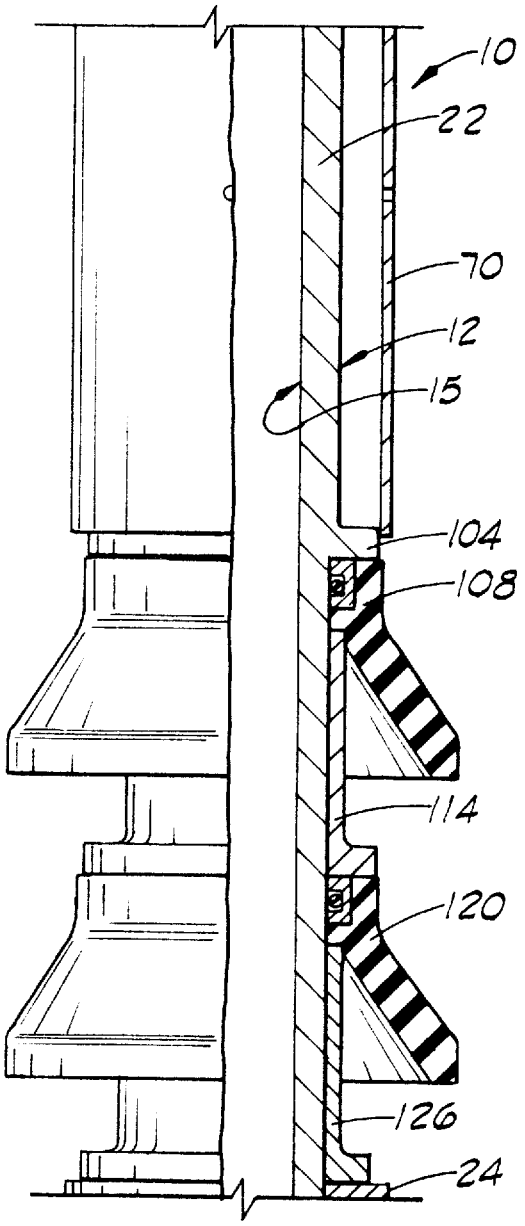
FIG. 7 is a side elevational view, partially in cross-section, similar to FIG. 3 but showing the lower intermediate portion of the tool after the cup type packers have been released and have expanded.
Figure 8:
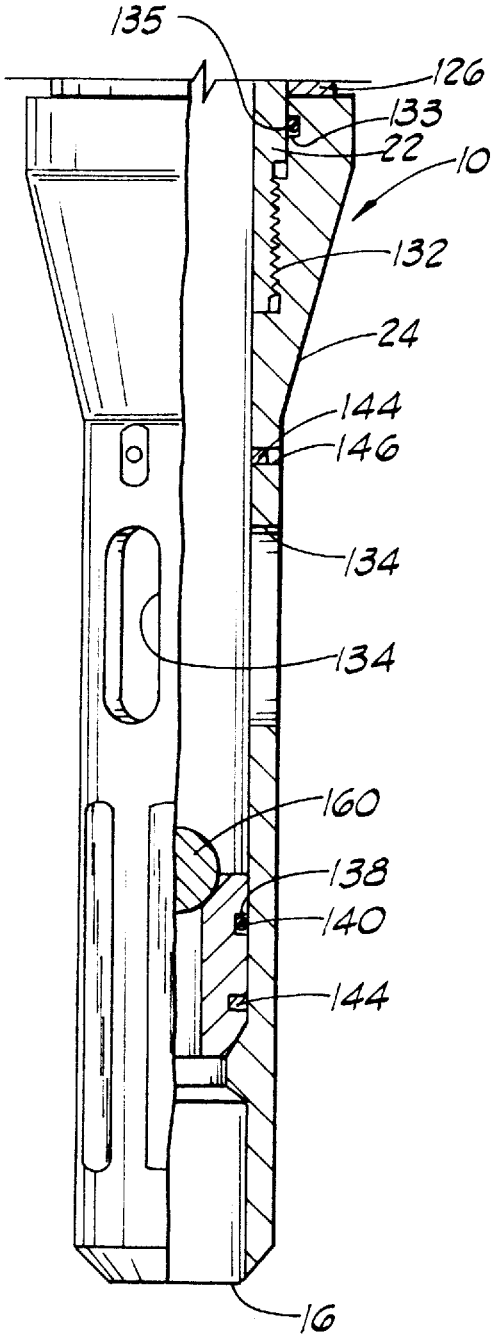
FIG. 8 is a side elevational view, partially in cross-section, similar to FIG. 4 but showing the lower portion of the tool after the sleeve valve has moved downwardly.

A closing plug, such as the ball 160 illustrated in FIG. 4 in dashed lines and in FIG. 8, is dropped through the tubing or pipe string into the tool whereby the sleeve valve 136 and the axial fluid flow passageway 15 are closed. The fluid pressure exerted on the tool above the closed sleeve valve 136 is then increased to the first predetermined fluid pressure whereby the shear pin 76 is sheared and the tubular piston member 60 is moved upwardly on the inner mandrel 12 into latching engagement with the collet 46 as shown in FIG. 5. That is, the upwardly facing shoulders 56 of the collet fingers 50 are engaged by the downwardly facing shoulder 74 of the collet retainer 62. Simultaneously, the cup type packers 108 and 120 are uncovered and released by the sliding packer retaining sleeve of the tubular piston member 60 as shown in FIG. 7. When released, the packers 108 and 120 expand into contact with the casing cemented in the well bore (not shown) to provide a seal between the tool 10 and the casing and to prevent the treatment fluid discharged below the packers from flowing upwardly in the casing past the tool 10.

The tool 10 is next positioned within the casing whereby the packer 120 is located above a selected set or sets of perforations into which it is desired to inject the treating fluid. Thereafter, the fluid pressure exerted within the tool 10 is increased to the second predetermined fluid pressure whereby the shear pin 144 maintaining the sleeve valve 136 in its first position is sheared, and the sleeve valve 136 as well as the closing plug 160 are moved to the sleeve valve's second position below the lateral ports 134 as illustrated in FIG. 8. Upon the movement of the sleeve valve 136 and closing ball 160 to the sleeve valve's second position, the lateral ports 134 in the ported member 24 are opened and the treatment fluid is discharged into the casing below the packers 108 and 120. The packers 108 and 120 prevent the treating fluid from flowing upwardly around the tool 10 and force the treating fluid into the selected set or sets of perforations.

In a preferred method of placing a treating fluid such as a carrier liquid-hardenable resin coated pack sand suspension in all the perforations in a producing interval, the tool 10 is positioned above the lowest set of perforations and operated to place the treating fluid therein. The tool 10 is then successively moved to each set of perforations above the lowest set and the treatment fluid is placed in each set. This technique insures that all the perforations receive the treatment fluid and are packed, even though the permeability of the interval increases drastically from bottom to top.

Thus, the present invention is well adapted to carry out the objects and attain the benefits and advantages mentioned as well as those which are inherent therein. While numerous changes to the apparatus and methods can be made by those skilled in the art, such changes are encompassed within the spirit of this invention as defined by the appended claims.

What is claimed is:

1. A tool for placing a treatment fluid in a subterranean formation penetrated by a well bore by way of selected perforations extending from casing cemented in the well bore into the formation, comprising:

an elongated inner mandrel having an axial fluid flow passageway therethrough adapted to be connected at one end to tubing or a pipe string and having at least one lateral fluid flow port therein, said inner mandrel also including an outer shoulder formed thereon and a lateral fluid passage extending from said axial fluid flow passageway to the exterior of said inner mandrel near said shoulder;

at least one resilient self expandable cup type packer for providing a seal between said inner mandrel and said casing in said well bore attached to said inner mandrel between said outer shoulder on said inner mandrel and said lateral fluid flow port therein;

a tubular piston member slidably extending over said inner mandrel and over said cup type packer attached thereto having an inner shoulder formed therein which is complimentary to said outer shoulder on said inner mandrel whereby fluid pressure exerted between said shoulders by way of said lateral passage and said axial fluid flow passageway of said inner mandrel moves said piston member from a first position whereby said cup type packer is covered and compressed inwardly by said tubular piston member to a second position whereby said cup type packer is uncovered by said tubular piston member;

first shearable means attached between said inner mandrel and said tubular piston member for maintaining said tubular piston member in said first position until a predetermined fluid pressure is exerted between said shoulders of said inner mandrel and said piston member;

a sleeve valve having an annular seat formed thereon for receiving a closing plug slidably disposed within said fluid flow passageway of said inner mandrel whereby when fluid pressure is exerted on said sleeve valve with said closing plug seated thereon, said sleeve valve moves from a first position whereby said lateral fluid flow port of said inner mandrel is closed to a second position whereby said lateral fluid flow port is open; and second shearable means attached between said sleeve valve and said inner mandrel for maintaining said sleeve valve in said first position until a predetermined fluid pressure is exerted on said sleeve valve.

2. The tool of claim 1 wherein said first shearable means attached between said sleeve valve and said inner mandrel are comprised of one or more shear pins.

3. The tool of claim 1 wherein said closing plug is in the form of a ball.

4. The tool of claim 1 wherein said inner mandrel includes two or more of said lateral fluid flow ports therein.

5. The tool of claim 1 wherein said second shearable means attached between said inner mandrel and said tubular piston member are comprised of one or more shear pins.

6. The tool of claim 1 wherein two or more of said resilient self expandable cup type packers are attached to said inner mandrel which are covered and compressed inwardly by said tubular piston member when said tubular piston member is in its first position.

7. The tool of claim 1 which further comprises means for retaining said tubular piston member in its second position after said tubular piston member is moved thereto attached to said inner mandrel.

8. The tool of claim 7 wherein said means for retaining said tubular piston member in its second position comprise:

said tubular piston member including a collet retainer attached thereto; and a collet for releasably engaging said collet retainer attached to said inner mandrel and positioned to engage said collet retainer when said tubular piston member moves to its second position.

9. A tool for placing a treatment fluid in a subterranean formation penetrated by a well bore by way of selected perforations extending from casing cemented in the well bore into the formation, comprising:

an elongated cylindrical inner mandrel having an upper end and a lower end, having a fluid flow passageway therethrough, having at least one lateral fluid flow port therein and being adapted at said upper end to be connected to tubing or a pipe string, said inner mandrel also including an outer shoulder formed thereon and a lateral fluid passage extending from said axial fluid flow passageway to the exterior of said inner mandrel above said shoulder;

two resilient self expandable cup type packers for providing a seal between said inner mandrel and said casing in said well bore attached to said inner mandrel below said outer shoulder on said inner mandrel;

a tubular piston member slidably extending over said inner mandrel and over said cup type packers attached thereto having an inner shoulder formed therein which is above and complimentary to said outer shoulder on said inner mandrel whereby fluid pressure exerted between said shoulders by way of said lateral passage and said axial fluid flow passageway of said inner mandrel moves said piston member upwardly from a first position whereby said cup type packers are covered and compressed inwardly by said tubular piston member to a second position whereby said cup type packers are uncovered by said tubular piston member;

means for retaining said tubular piston member in its second position after said tubular piston member is moved thereto attached to said tubular piston member and to said inner mandrel;

at least one shear pin attached between said inner mandrel and said tubular piston member for maintaining said tubular piston member in said first position until a predetermined fluid pressure is exerted between said shoulders of said inner mandrel and said piston member;

a sleeve valve having an annular seat formed thereon for receiving a closing plug slidably disposed within said fluid flow passageway of said inner mandrel above said lateral fluid flow port therein whereby when fluid pressure is exerted on said sleeve valve with said closing plug seated thereon, said sleeve valve moves from a first position above said lateral fluid flow port of said inner mandrel whereby said lateral fluid flow port is closed to a second position below said lateral fluid flow port whereby said lateral fluid flow port is open; and at least one shear pin attached between said sleeve valve and said inner mandrel for maintaining said sleeve valve in said first position until a predetermined fluid pressure is exerted on said sleeve valve.

10. The tool of claim 9 wherein said means for retaining said tubular piston member in its second position comprise:

said tubular piston member including a collet retainer attached thereto; and a collet for releasably engaging said collet retainer attached to said inner mandrel and positioned to engage said collet retainer when said tubular piston member moves to its second position.

11. A method of placing a treatment fluid in a selected portion of a producing interval in a subterranean formation penetrated by a well bore and by a plurality of perforations extending from casing cemented in the well bore into the producing interval, comprising the steps of:

(a) connecting a fluid placement tool to tubing or a pipe string, said fluid placement tool having a fluid flow passageway extending therethrough, having at least one resilient self expandable cup type packer attached thereto and having a valve disposed in said fluid flow passageway which closes said fluid flow passageway when a closing plug is dropped into said tool, said placement tool being capable of releasing said cup type packer whereby it provides a seal between said tool and said casing when a first predetermined fluid pressure is applied to said tool after a closing plug is dropped into said tool and opening said fluid flow passageway whereby said treatment fluid is discharged from said tool below said packer when said fluid pressure is increased to a second predetermined fluid pressure;

(b) lowering said tool and said tubing or pipe string in said well bore to said formation and dropping a closing plug into said tool whereby said valve and said fluid flow passageway of said tool are closed;

(c) increasing the fluid pressure exerted on said tool to said first predetermined fluid pressure whereby said cup type packer is released;

(d) positioning said tool whereby said packer is above a selected set or group of said perforations; and (e) increasing said fluid pressure exerted on said tool to said second predetermined fluid pressure whereby said fluid flow passageway is opened and said treatment fluid is placed in the portion of said producing interval penetrated by said selected perforations.

12. The method of claim 11 wherein said tool includes a tubular piston member which moves on said tool when said fluid pressure is increased to said first predetermined fluid pressure to thereby release said cup type packer in accordance with step (c).

13. The method of claim 12 wherein said tubular piston member is prevented from moving until said first predetermined fluid pressure is reached by at least one shear pin connected between said tubular piston member and said tool.

14. The method of claim 11 wherein said tool includes a lateral fluid flow port therein below said packer and below said valve and when said fluid pressure is increased to said second predetermined fluid pressure, said valve is moved to a position below said lateral fluid flow port thereby opening said fluid flow passageway in accordance with step (e).

15. The method of claim 14 wherein said valve is prevented from moving until said second predetermined fluid pressure is reached by at least one shear pin connected between said valve and said tool.

16. The method of claim 11 wherein said closing plug is in the form of a ball.

17. The method of claim 11 wherein said treatment fluid is a suspension of particulate solids in a carrier liquid.

18. The method of claim 11 wherein said selected set or group of said perforations is the lowest set of perforations penetrating said producing interval of said formation.

19. The method of claim 18 which first comprises successively moving said tool to each set of perforations above said lowest set of perforations and successively placing said treatment fluid in said producing interval of said formation by way of said sets of perforations.

20. The method of claim 19 wherein said treatment fluid is a suspension of hardenable resin coated sand in a carrier liquid.

* * * * *